US011480908B2

(12) United States Patent
Yokoyama

(10) Patent No.: US 11,480,908 B2
(45) Date of Patent: Oct. 25, 2022

(54) POST-PROCESSING APPARATUS

(71) Applicant: CANON KABUSHIKI KAISHA, Tokyo (JP)

(72) Inventor: Seiji Yokoyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 102 days.

(21) Appl. No.: 16/854,604

(22) Filed: Apr. 21, 2020

(65) Prior Publication Data

US 2020/0249611 A1 Aug. 6, 2020

Related U.S. Application Data

(63) Continuation of application No. 15/961,662, filed on Apr. 24, 2018, now Pat. No. 10,663,905.

(30) Foreign Application Priority Data

Apr. 27, 2017 (JP) ..... JP2017-088487

(51) Int. Cl.
*B31F 5/00* (2006.01)
*B65H 37/04* (2006.01)
(Continued)

(52) U.S. Cl.
CPC ..... *G03G 15/6544* (2013.01); *B31F 5/001* (2013.01); *B65H 37/04* (2013.01);
(Continued)

(58) Field of Classification Search
CPC ... B31F 5/00; B31F 5/001; B31F 5/02; B65H 37/04; B65H 43/08; B65H 2301/51611; B65H 2511/51; B65H 2511/515; B65H 2557/60; B65H 2801/27; G01G 15/00; G01G 15/553; G01G 15/6544;
(Continued)

(56) References Cited

U.S. PATENT DOCUMENTS 4,795,071 A * 1/1989 Jacobs ..... G03G 15/60 227/7
5,221,953 A * 6/1993 Higaki ..... G03G 15/6541 270/58.08
5,382,016 A * 1/1995 Kobayashi ..... B42C 1/125 270/58.16
5,895,036 A * 4/1999 Asao ..... B42C 1/12 270/58.09
(Continued)

FOREIGN PATENT DOCUMENTS

JP 2007-230735 A 9/2007
JP 2009-012892 A 1/2009
JP 2015003811 A * 1/2015 ..... B65H 37/04

*Primary Examiner* — Nguyen Q. Ha
(74) *Attorney, Agent, or Firm* — Canon U.S.A., Inc. I.P. Division

(57) ABSTRACT

According to one embodiment of the present disclosure, a post-processing apparatus includes a stapling unit which includes a cartridge for containing a staple used for stapling processing, a moving unit configured to move the stapling unit between a first stapling position, a second stapling position and a replacement position, a detection unit configured to detect presence or absence of a staple in the cartridge, and a control unit configured to make the stapling unit stand ready at the second stapling position in a case where the presence of a staple in the cartridge is detected by the detection unit, and to make the moving unit move the stapling unit to the replacement position in a case where the absence of a staple in the cartridge is detected by the detection unit.

6 Claims, 7 Drawing Sheets

(51) Int. Cl.
*G03G 15/00* (2006.01)
*G03G 21/00* (2006.01)
*B65H 43/08* (2006.01)

(52) U.S. Cl.
CPC ..... *B65H 43/08* (2013.01); *G03G 15/553* (2013.01); *B65H 2301/51611* (2013.01); *B65H 2511/51* (2013.01); *B65H 2511/515* (2013.01); *B65H 2557/60* (2013.01); *B65H 2801/27* (2013.01); *G03G 2215/00827* (2013.01)

(58) Field of Classification Search
CPC ..... G03G 21/00; G03G 2215/00827; G03G 15/00; G03G 15/553; G03G 15/6544
See application file for complete search history.

(56) References Cited

U.S. PATENT DOCUMENTS

| | | | | |
|---|---|---|---|---|
| 10,663,905 | B2 * | 5/2020 | Yokoyama | B31F 5/001 |
| 10,829,336 | B2 * | 11/2020 | Komiyama | B42B 5/00 |
| 2015/0165809 | A1 * | 6/2015 | Komiyama | B65H 31/3081 412/38 |
| 2016/0059608 | A1 * | 3/2016 | Kubo | G03G 15/6541 270/58.09 |
| 2016/0096391 | A1 * | 4/2016 | Shimura | G03G 15/6544 270/58.11 |
| 2016/0205279 | A1 * | 7/2016 | Yokoyama | H04N 1/00708 358/1.12 |
| 2017/0305707 | A1 * | 10/2017 | Iguchi | B65H 43/00 |
| 2018/0281226 | A1 * | 10/2018 | Lee | B27F 7/36 |

* cited by examiner

101
DISCHARGE DIRECTION

POST-PROCESSING APPARATUS

CROSS REFERENCE TO RELATED APPLICATIONS

The present application is a continuation of U.S. patent application Ser. No. 15/961,662, filed on Apr. 24, 2018, which claims priority from Japanese Patent Application No. 2017-088487 filed Apr. 27, 2017, which is hereby incorporated by reference herein in its entirety.

BACKGROUND

Field

The present disclosure relates to a post-processing apparatus which executes stapling processing on a recording material.

Description of the Related Art

Post-processing apparatuses which receive recording materials discharged from an image forming apparatus such as a copying machine or a printer to execute post-processing include a post-processing apparatus which executes stapling processing on received recording materials (hereinafter, this function is referred to as "automatic stapling"). Further, there is provided another post-processing apparatus which executes stapling processing on recording materials inserted from an outside by a user (hereinafter, this function is referred to as "manual stapling").

Japanese Patent Application Laid-Open No. 2015-030592 discusses a post-processing apparatus which realizes both an automatic stapling function and a manual stapling function through one stapling unit instead of realizing the two functions by separate stapling units. Staples used for stapling are collectively contained in a cartridge, so that the user can open the door of the post-processing apparatus to easily replenish the staples by replacing the cartridge. The staple unit is movable between a position where manual stapling is executed, i.e., manual stapling position, and a position where the cartridge is replaced, i.e., cartridge replacement position.

In Japanese Patent Application Laid-Open No. 2015-030592, if the cartridge replacement position is set as a stand-by position of the stapling unit, it can take a long time to complete manual stapling because time for moving the stapling unit is necessary. On the other hand, if the manual stapling unit is set as a stand-by position of the stapling unit, the user has to input a replacement instruction through a control panel or a button to move the stapling unit to the cartridge replacement position in order to replace the cartridge. In other words, the operation to be performed by the user to achieve the desired functionality can become complicated, and thus the usability will be lowered.

SUMMARY

Various embodiments of the present disclosure are directed to a post-processing apparatus which suppresses lowering of usability at the time of replacing a cartridge while promptly executing manual stapling.

According to one embodiment, a post-processing apparatus connectable to an image forming apparatus is provided. The image forming apparatus is for forming an image on a recording material, and the post-processing apparatus includes a stapling unit including a cartridge for containing a staple used for stapling processing, the stapling unit configured to execute the stapling processing on a recording material, a moving unit configured to move the stapling unit between a first stapling position at which the stapling processing is executed on a recording material discharged from the image forming apparatus in a state where the post-processing apparatus is connected to the image forming apparatus, a second stapling position at which the stapling processing is executed on a recording material inserted from an outside of a main body of the post-processing apparatus without interposing the image forming apparatus, and a replacement position at which the cartridge is replaceable if a door provided on the main body is opened, a detection unit configured to detect presence or absence of a staple in the cartridge, and a control unit configured to make the stapling unit stand ready at the second stapling position in a case where the presence of a staple in the cartridge is detected by the detection unit, and to make the moving unit move the stapling unit to the replacement position in a case where the absence of a staple in the cartridge is detected by the detection unit.

According to another embodiment, a post-processing apparatus connectable to an image forming apparatus is provided. The image forming apparatus is for forming an image on a recording material, and the post-processing apparatus includes a stapling unit including a cartridge for containing a staple used for stapling processing, the stapling unit configured to execute the stapling processing on a recording material, a moving unit configured to move the stapling unit between a stapling position at which the stapling processing is executed on a recording material discharged from the image forming apparatus in a state where the post-processing apparatus is connected to the image forming apparatus, and a replacement position at which the cartridge is replaceable if a door provided on a main body of the post-processing apparatus is opened, wherein the stapling unit can execute the stapling processing on a recording material inserted from an outside of the main body without interposing the image forming apparatus in a state where the stapling unit is positioned at the stapling position, a detection unit configured to detect presence or absence of a staple in the cartridge, and a control unit configured to make the stapling unit stand ready at the stapling position in a case where the presence of a staple in the cartridge is detected by the detection unit, and to make the moving unit move the stapling unit to the replacement position in a case where the absence of a staple in the cartridge is detected by the detection unit.

Further features will become apparent from the following description of exemplary embodiments with reference to the attached drawings.

DESCRIPTION OF THE EMBODIMENTS

In a first exemplary embodiment, a post-processing apparatus where a slit used for manual stapling is formed on an apparatus main unit (also called as "housing") will be described. Then, a stapling unit that performs automatic stapling and manual stapling at different positions will be described.

Figures 1A, 1B:
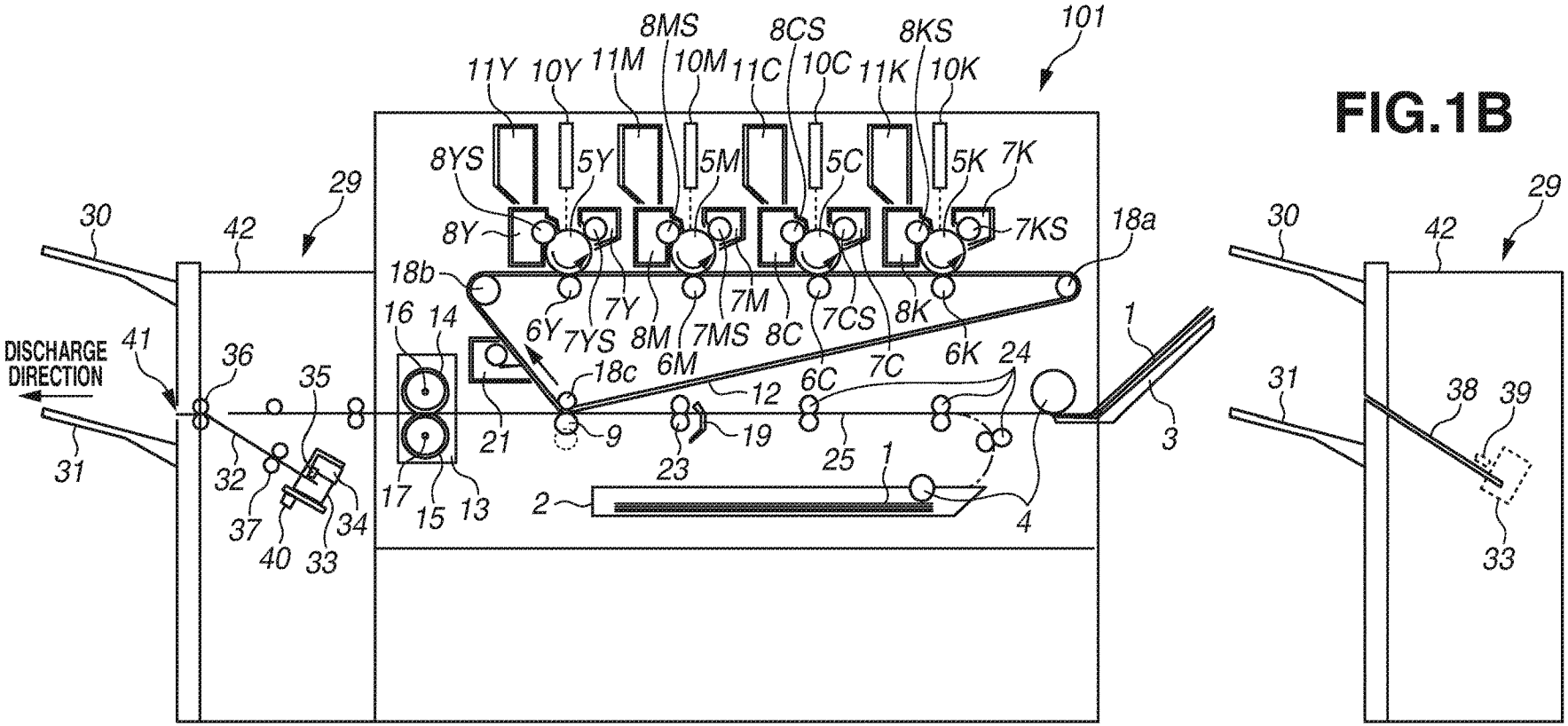
FIGS. 1A and 1B illustrate configurations of an image forming apparatus and a post-processing apparatus of a first exemplary embodiment.

FIGS. 1A and 1B illustrate configurations of an image forming apparatus 101 and a post-processing apparatus 29 of the present exemplary embodiment. FIG. 1A illustrates a state where the post-processing apparatus 29 is connected to the image forming apparatus 101, whereas FIG. 1B illustrates an external view of the post-processing apparatus 29.

The image forming apparatus 101 is an electrophotographic type color laser beam printer. The image forming apparatus 101 includes photosensitive drums 5Y, 5M, 5C, and 5K configured of aluminum cylinders having organic photoconductive layers applied to outer circumferential faces thereof, which are provided at respective stations arranged by the number corresponding to the number of development colors. Herein, symbols Y, M, C, and K respectively represent yellow, magenta, cyan, and black, and the symbols will be omitted except when necessary. The image forming apparatus 101 includes charging units 7, laser scanners 10, development units 8, toner cartridges 11, an intermediate transfer belt 12, primary transfer rollers 6, a secondary transfer roller 9, and a fixing unit 13.

When printing is started, the photosensitive drums 5 are rotated by a driving motor (not illustrated) in a counter-clockwise direction indicated by arrows in FIG. 1A. The charging units 7 include charging sleeves 7S (7YS, 7MS, 7CS, and 7KS) for charging the photosensitive drums 5. The surfaces of the photosensitive drums 5 charged by the charging sleeves 7S are exposed to light by the laser scanners 10. The laser scanners 10 expose the photosensitive drums 5 to light based on input image data, so that electrostatic latent images are formed on the photosensitive drums 5. The development units 8 include development sleeves 8S (8YS, 8MS, 8CS, and 8CK) for visualizing the electrostatic latent images formed on the photosensitive drums 5. The development sleeves 8S supply toner to the photosensitive drums 5, so that the electrostatic latent images are visualized as toner images.

The intermediate transfer belt 12 is an endless belt stretched upon a driving roller 18*a* and driven rollers 18*b* and 18*c*. The intermediate transfer belt 12 abuts on the photosensitive drums 5, and is rotated by the driving roller 18*a* in a clockwise direction indicated by an arrow in FIG. 1A. Then, the toner images are sequentially transferred to the intermediate transfer belt 12 by the primary transfer rollers 6 (hereinafter, this processing is called as "primary transfer"). The toner images of respective colors are overlapped and transferred onto the intermediate transfer belt 12, so that a color image is formed on the intermediate transfer belt 12.

Sheets 1 (recording materials) are placed on a sheet feeding cassette 2 or a multi-tray 3. A sheet feeding roller 4 feeds each sheet 1 to a conveyance path 25 from the sheet feeding cassette 2 or the multi-tray 3. The sheet 1 fed to the conveyance path 25 is conveyed toward a registration sensor 19 by a conveyance roller 24. When the registration sensor 19 detects a leading end of the sheet 1, the sheet 1 is further conveyed by a certain amount, and abuts on a registration roller 23 that is in a stopped state. With this operation, a slack (also called "loop") is formed on the sheet 1. The registration roller 23 conveys the stopped sheet 1 to the secondary transfer roller 9 again while adjusting a conveyance timing with that of the toner image formed on the intermediate transfer belt 12. The sheet 1 is nipped and conveyed by the intermediate transfer belt 12 and the secondary transfer roller 9, so that the toner image formed on the intermediate transfer belt 12 is collectively transferred to the sheet 1 (hereinafter, this processing is called as "secondary transfer"). The secondary transfer roller 9 moves to a position indicated by a solid line to abut on the intermediate transfer belt 12 when secondary transfer is executed. The secondary transfer roller 9 moves to a position indicated by a dotted line to separate from the intermediate transfer belt 12 when secondary transfer is not executed.

The fixing unit 13 conveys the sheet 1 and fixes the transferred toner image on the sheet 1. The fixing unit 13 includes a fixing roller 14 for heating the sheet 1 and a pressure roller 15 for pressurizing the sheet 1 onto the fixing roller 14. The fixing roller 14 and the pressure roller 15 are formed into hollow shapes, and heaters 16 and 17 are respectively arranged on the inner portions thereof. A cleaning device 21 removes toner remaining in the intermediate transfer belt 12. The removed toner is contained in a cleaner container included in the cleaning device 21.

The post-processing apparatus 29 receives sheets discharged from the image forming apparatus 101 and executes post processing on the received sheets 1. For example, the post-processing apparatus 29 has a function of sorting the received sheets 1 to a plurality of discharge trays 30 and 31, and a function of binding the plurality of sheets 1 by executing stapling processing (binding processing). The discharge trays 30 and 31 are moved up and down by a motor (not illustrated) for lifting or lowering the discharge trays 30 and 31 when the sheets 1 are sorted thereto.

A configuration relating to the stapling processing will be described below in detail. A stapling unit 33 executes stapling processing on a plurality of sheets 1 stacked on a stapling tray 32. The stapling unit 33 further includes a staple cartridge 34 and a staple presence/absence detection sensor 35. The staple cartridge 34 collectively contains staples used for the stapling processing, and the staple presence/absence detection sensor 35 is provided in order to detect whether a staple remains in the staple cartridge 34. When absence of a staple is detected by the staple presence/absence detection sensor 35, information indicating absence of a staple is notified to a controller 301 to be described below.

In a case where stapling processing is executed on the sheets 1 discharged from the image forming apparatus 101, the stapling unit 33 is moved by a stapling unit moving mechanism 40. Positions to which the stapling unit 33 is to be moved will be described below in detail. When a trailing end of the sheet 1 conveyed to the post-processing apparatus 29 from the image forming apparatus 101 has reached a discharge roller pair 36, the discharge roller pair 36 and a drawing roller pair 37 are inversely rotated, so that the sheet 1 is drawn and stacked on the stapling tray 32. After the sheets 1 of a prespecified number are stacked on the stapling tray 32, stapling processing is executed by the stapling unit 33. A bundle of sheets 1 subjected to the stapling processing is discharged to the discharge tray 30 or 31 by the discharge roller pair 36 through a discharge port 41 formed on the apparatus main unit 42. Hereinafter, this function is called as "automatic stapling".

Further, as illustrated in the external view in FIG. 1B, the post-processing apparatus 29 of the present exemplary embodiment includes a slit 38 formed at a side face of the apparatus main unit 42. The side face of the apparatus main unit 42 refers to a side face viewed from a downstream side of a direction (discharge direction) in which the sheet 1 is discharged by the discharge roller pair 36. The user can insert a bundle of sheets 1 into the slit 38. The bundle of sheets 1 inserted from the outside of the apparatus main unit 42 through the slit 38 is detected by a sheet detection sensor 39 (recording material detection sensor). When the sheet detection sensor 39 detects the bundle of sheets 1, stapling processing is executed thereon by the stapling unit 33. Hereinafter, this function is called as "manual stapling".

Figure 2A:
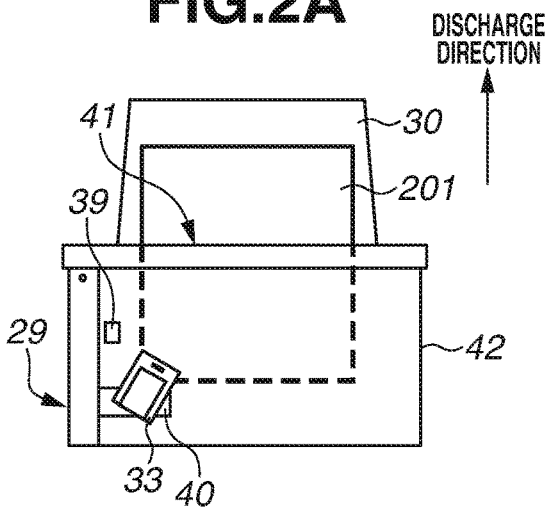
FIGS. 2A, 2B, 2C, and 2D are overhead views of the post-processing apparatus illustrating positions of a stapling unit of the first exemplary embodiment.
Figure 2B:
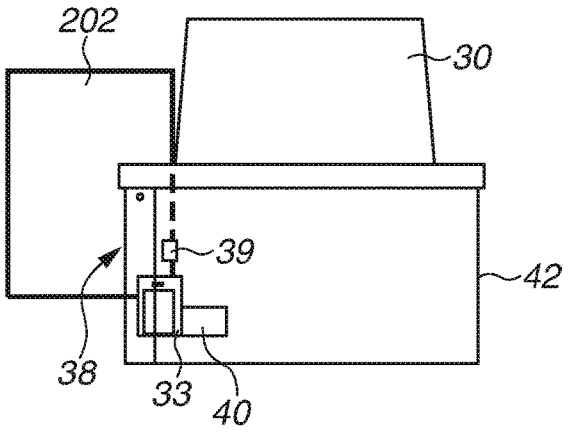
Figure 2C:
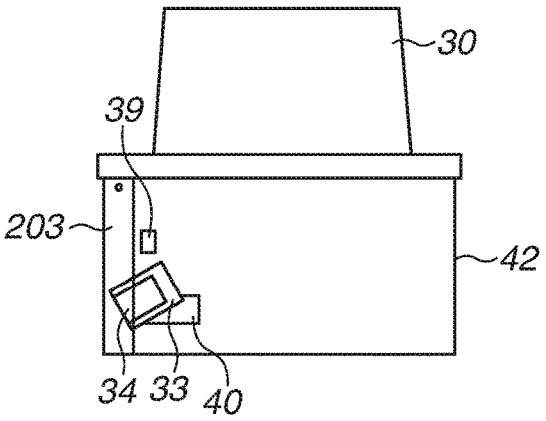
Figure 2D:
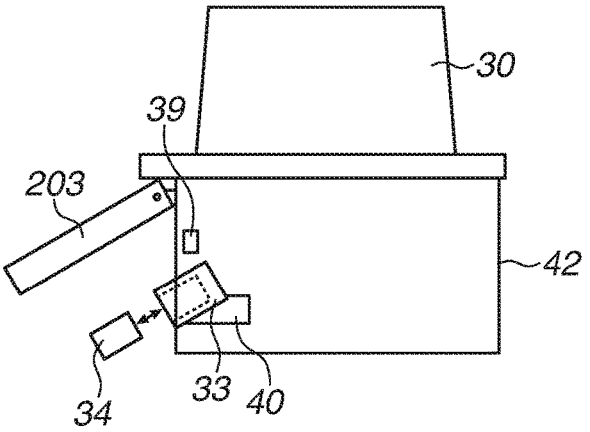

FIGS. 2A to 2D are overhead views of the post-processing apparatus 29 illustrating positions of the stapling unit 33. FIG. 2A illustrates a position of the stapling unit 33 at which the stapling processing is executed on a sheet bundle 201 discharged from the image forming apparatus 101, i.e., automatic stapling position. FIG. 2B illustrates a position of the stapling unit 33 at which the stapling processing is executed on a sheet bundle 202 inserted by the user through the slit 38, i.e., manual stapling position. FIG. 2C illustrates a position of the stapling unit 33 at which the staple cartridge 34 is replaced, i.e., cartridge replacement position. As illustrated in FIG. 2D, the user can open a door 203 to take out the staple cartridge 34 from the stapling unit 33 at the cartridge replacement position. In other words, the user can access and replace the staple cartridge 34 with a new cartridge when there is no staple in the staple cartridge 34. In addition, the door 203 is provided on a face that is the same as the side face of the apparatus main unit 42 where the slit 38 is formed.

As illustrated in FIG. 2A, the stapling unit 33 is movable in a direction orthogonal to a discharge direction of the sheet bundle 201, i.e., a width direction of the sheet bundle 201. When the automatic stapling position, the manual stapling position, and the cartridge replacement position are compared to one another, the cartridge replacement position is set at a position closer to the door 203 than the other two positions in the direction orthogonal to the discharge direction of the sheet bundle 201.

Figure 3:
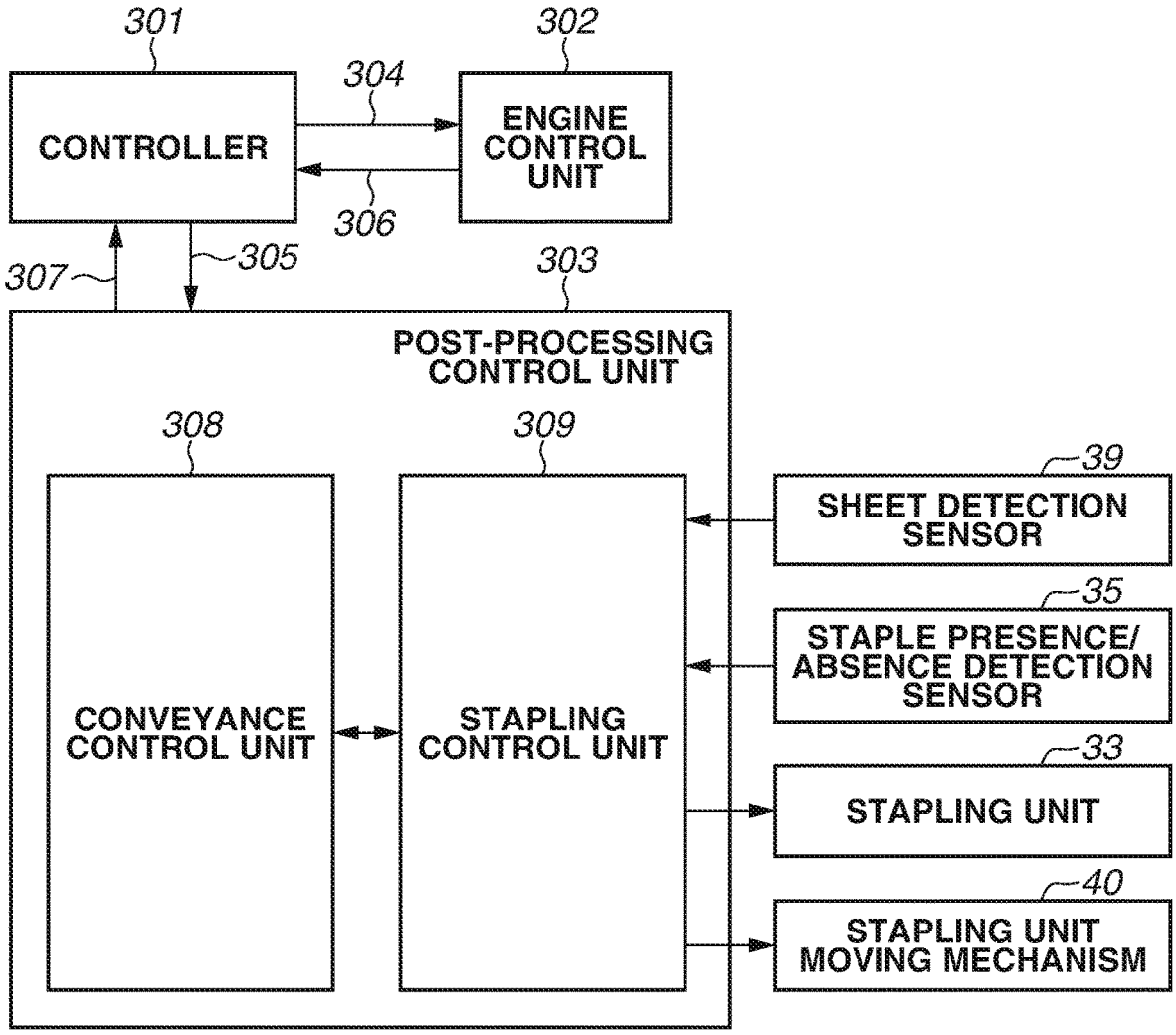
FIG. 3 is a block diagram illustrating system configurations of the image forming apparatus and the post-processing apparatus of the first exemplary embodiment.

FIG. 3 is a block diagram illustrating system configurations of the image forming apparatus 101 and the post-processing apparatus 29. A controller 301 comprehensively controls the image forming apparatus 101 and the post-processing apparatus 29. An engine control unit 302 controls the image forming apparatus 101, whereas a post-processing control unit 303 controls the post-processing apparatus 29. A serial signal line 304 transmits a command signal to the engine control unit 302 from the controller 301, and a serial signal line 305 transmits a command signal to the post-processing control unit 303 from the controller 301. A serial signal line 306 transmits status data to the controller 301 from the engine control unit 302 in response to the command signal, and a serial signal line 307 transmits status data to the controller 301 from the post-processing control unit 303 in response to the command signal. The controller 301 transmits command signals to the engine control unit 302 and the post-processing control unit 303, and receives status data from the engine control unit 302 and the post-processing unit 303 to execute control processing. As describe above, when a plurality of apparatuses is connected to execute operations, the controller 301 centrally manages control processing or a state of each of the apparatuses to maintain consistency between the operations executed by the apparatuses. In addition, the controller 301 and the engine control unit 302 are provided on the image forming apparatus 101, whereas the post-processing control unit 303 is provided on the post-processing apparatus 29.

The post-processing control unit 303 includes a conveyance control unit 308 and a stapling control unit 309. The conveyance control unit 308 controls conveyance operation of the sheets 1 according to the command signal transmitted from the controller 301. When automatic stapling is executed, the conveyance control unit 308 instructs the stapling control unit 309 to execute stapling processing with respect to the bundle of sheets 1 discharged from the image forming apparatus 101. The stapling control unit 309 is connected to the sheet detection sensor 39, the staple presence/absence detection sensor 35, the stapling unit 33, and the stapling unit moving mechanism 40.

Figure 4:
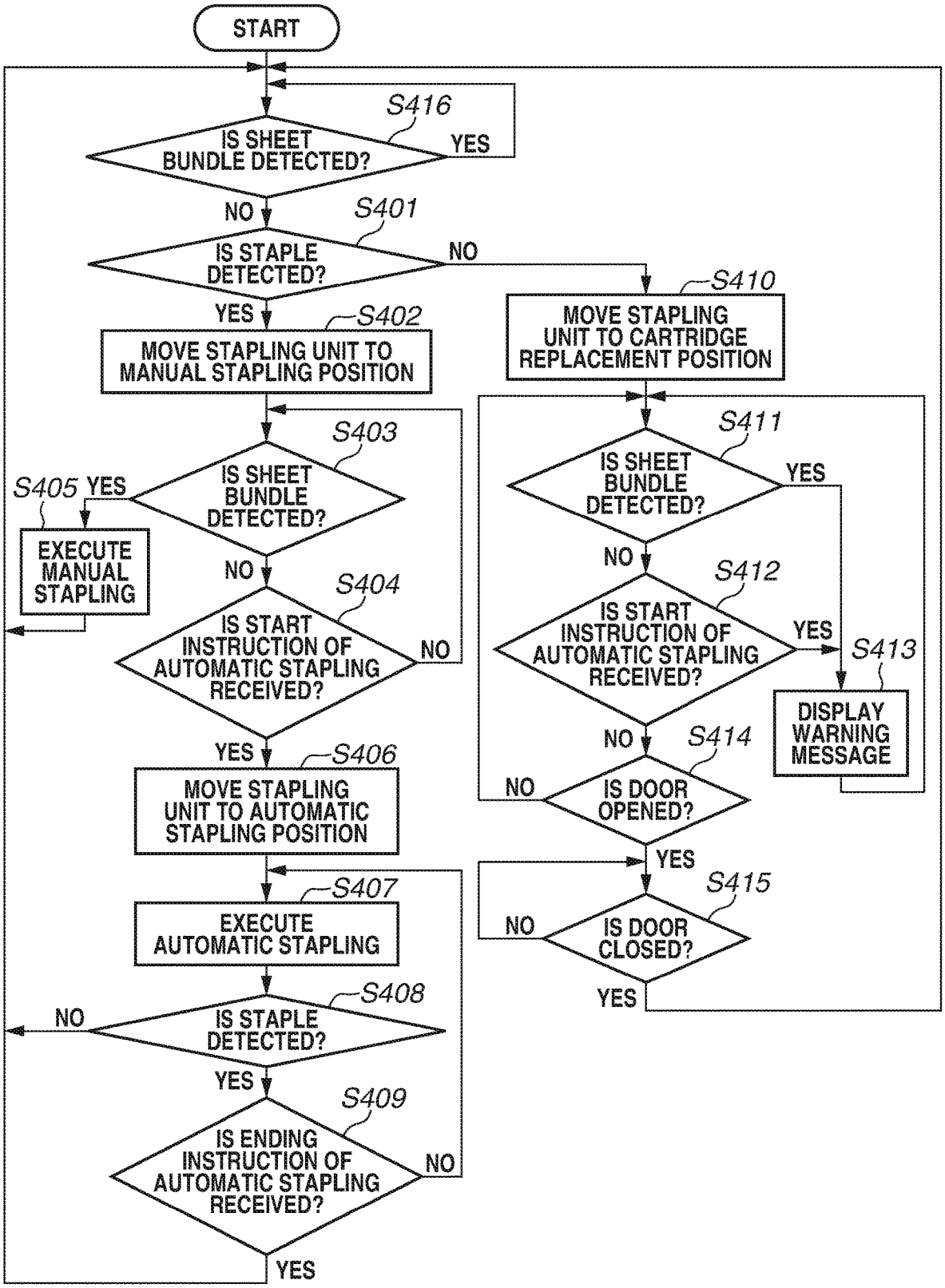
FIG. 4 is a flowchart illustrating operation of a stapling control unit of the first exemplary embodiment.

FIG. 4 is a flowchart illustrating operation of the stapling control unit 309 of the present exemplary embodiment. The control according to the flowchart in FIG. 4 is executed by a central processing unit (CPU) mounted on the stapling control unit 309 based on a program stored in a read only memory (ROM).

First, at the time of executing initialization processing of the post-processing apparatus 29, in step S416, the stapling control unit 309 detects whether a sheet bundle is inserted to the slit 38 through the sheet detection sensor 39. If the sheet bundle is not inserted to the slit 38 (NO in step S416), the processing proceeds to step S401. In step S401, the stapling control unit 309 detects whether a staple remains in the staple cartridge 34 through the staple presence/absence detection sensor 35. Based on a detection result of the staple presence/absence detection senor 35, the stapling control unit 309 determines a stand-by position of the stapling unit 33.

In step S401, if a remaining staple is detected (YES in step S401), the processing proceeds to step S402. In step S402, the stapling control unit 309 controls the stapling unit moving mechanism 40 to move the stapling unit 33 to the manual stapling position. Thereafter, in step S403, the stapling control unit 309 monitors through the sheet detection sensor 39 whether a sheet bundle is inserted to the slit 38. If the sheet bundle is not inserted (NO in step S403), the processing proceeds to step S404. In step S404, the stapling control unit 309 monitors whether a start instruction of automatic stapling is received from the conveyance control unit 308. In step S403, if a sheet bundle inserted by the user is detected (YES in step S403), the processing proceeds to step S405. In step S405, the stapling control unit 309 makes the stapling unit 33 execute manual stapling. In other words, the stapling unit 33 executes stapling processing on the sheet bundle inserted to the slit 38. After the manual stapling is ended, in step S416, the stapling control unit 309 detects through the sheet detection sensor 39 whether the user has removed the sheet bundle from the slit 38. If the user has removed the sheet bundle from the slit 38, the processing returns to step S401, and the stapling control unit 309 determines a stand-by position of the stapling unit 33 based on the detection result of the staple presence/absence detection sensor 35.

In step S404, if a start instruction of automatic stapling is received from the conveyance control unit 308 (YES in step S404), the processing proceeds to step S406. In step S406, the stapling control unit 309 drives the stapling unit moving mechanism 40 to move the stapling unit 33 to the automatic stapling position. Thereafter, in step S407, according to the instruction received from the conveyance control unit 308, the stapling control unit 309 makes the stapling unit 33 execute automatic stapling. In other words, the stapling unit 33 executes stapling processing on the sheet bundle discharged from the image forming apparatus 101 and stacked on the stapling tray 32. Then, the stapling control unit 309 makes the stapling unit 33 repeatedly execute automatic stapling until absence of a staple is detected by the staple presence/absence detection sensor 35 in step S408 (NO in step S408), or an ending instruction of automatic stapling is received from the conveyance control unit 308 in step S409 (YES in step S409). Then, the processing returns to step S416, and the stapling control unit 309 determines a stand-by position of the stapling unit 33 based on the detection result of the staple presence/absence detection sensor 35.

In step S401, if absence of the staple is detected (NO in step S401), the processing proceeds to step S410. In step S410, the stapling control unit 309 controls the stapling unit moving mechanism 40 to move the stapling unit 33 to the cartridge replacement position. Then, the stapling control unit 309 waits for replacement of the staple cartridge 34 by the user. At this time, if insertion of the sheet bundle is detected by the sheet detection sensor 39 in step S411 (YES in step S411), or a start instruction of automatic stapling is received from the conveyance control unit 308 in step S412 (YES in step S412), the stapling unit 22 cannot execute stapling processing because there are no staples. Therefore, the stapling control unit 309 notifies the controller 301 that stapling processing is not executable, via the conveyance control unit 308. In step S413, the controller 301 receives the notification and displays a message or an image indicating that no staple is contained in the staple cartridge 34, on an operation panel (not illustrated) of the image forming apparatus 101 to prompt the user to replace the staple cartridge 34. If the door 203 are opened and closed by the user in steps S414 and S415 (YES in steps S414 and S415), there is a possibility that the staple cartridge 34 is replaced with new one. Therefore, the processing returns to step S401, and the stapling control unit 309 determines a stand-by position of the stapling unit based on the detection result of the staple presence/absence detection sensor 35.

As described above, according to the present exemplary embodiment, if there is a remaining staple, the manual stapling position is set as the stand-by position of the stapling unit 33, so that stapling processing can be executed immediately after the sheet bundle is inserted to the slit 38. Then, if there is no staple, the cartridge replacement position is set as the stand-by position of the stapling unit 33, so that the user can promptly replace the staple cartridge 34.

In a case where the staple does not remain in the staple cartridge 34 because of execution of manual stapling, the stapling control unit 309 does not change the position of the stapling unit 33 until removal of the sheet bundle is detected by the sheet detection sensor 39. This is because a leading end of the sheet bundle will be pressed against the stapling unit 33 to cause creases to be formed on the sheet bundle if the stapling unit 33 is moved in a state where the sheet bundle has been inserted. Accordingly, the stapling control unit 309 moves the stapling unit 33 to the cartridge replacement position after removal of the sheet bundle is detected by the sheet detection sensor 39.

In the configuration described in the first exemplary embodiment, the slit 38 used for manual stapling is formed on the apparatus main unit 42, and the stapling unit 33 executes automatic stapling and manual stapling at different positions.

In a configuration described in a second exemplary embodiment, the slit 38 used for manual stapling is not formed on the apparatus main unit 42, and the stapling unit 33 executes automatic stapling and manual stapling at the same position. In other words, manual stapling is also executable at the position at which automatic stapling is executed. A main portion of the configuration is similar to that described in the first exemplary embodiment, so that only a portion different from that in the first exemplary embodiment will be described.

Figure 5:
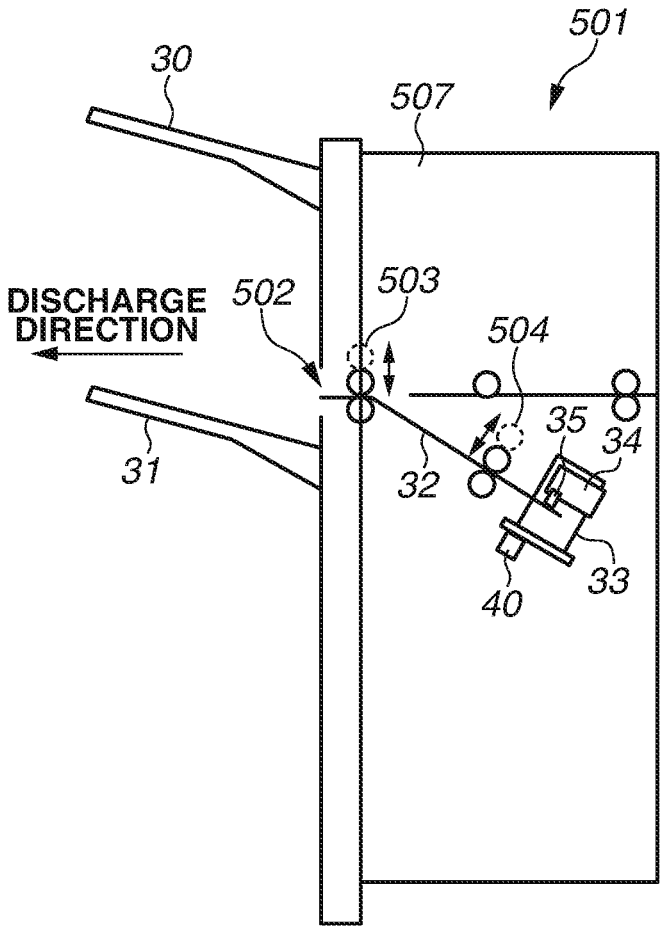
FIG. 5 illustrates a configuration of a post-processing apparatus of a second exemplary embodiment.

FIG. 5 illustrates a configuration of a post-processing apparatus 501 of the present exemplary embodiment. As illustrated in FIG. 5, the slit 38 described in the first exemplary embodiment is not formed on an apparatus main unit 507 of the post-processing apparatus 501. Instead, a user can perform manual stapling by inserting a sheet bundle to the stapling tray 32 from a discharge port 502. Herein, the discharge port 502 is an opening which a sheet bundle stapled by automatic stapling passes through when the sheet bundle is to be discharged to the discharge tray 30 or 31. At a printing stand-by state, one roller of each of a discharge roller pair 503 and a drawing roller pair 504 moves to a position indicated by a dotted line in FIG. 5 and separates from the other. With this configuration, the sheet bundle inserted by the user is not interrupted. When automatic stapling is executed, the one roller of each of the discharge roller pair 503 and the drawing roller pair 504 is moved to a position indicated by a solid line and each of the discharge roller pair 503 and the drawing roller pair 504 is brought into an abutting state. Then, as described in the first exemplary embodiment, the discharge roller pair 503 and the drawing roller pair 504 are inversely rotated while nipping the sheet 1 therebetween, so that the sheet 1 is drawn and stacked on the stapling tray 32.

Figure 6A:
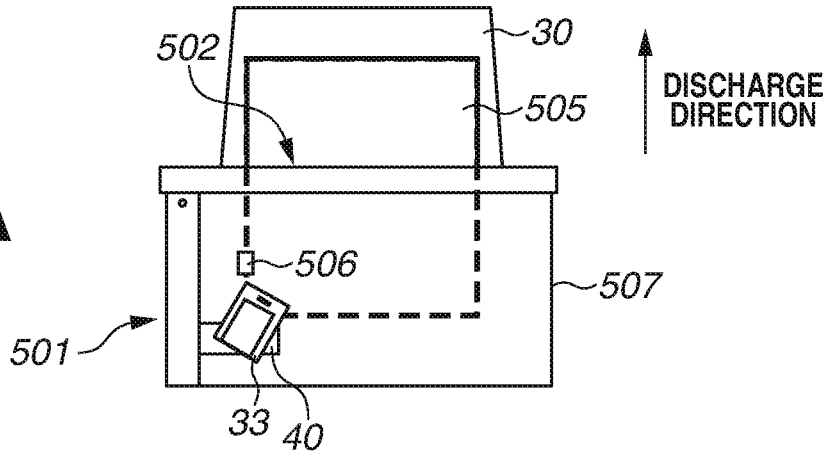
FIGS. 6A, 6B, and 6C are overhead views of the post-processing apparatus illustrating positions of a stapling unit of the second exemplary embodiment.
Figure 6B:
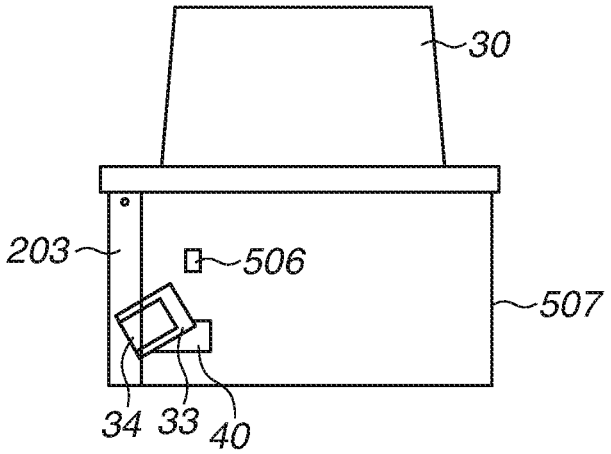
Figure 6C:
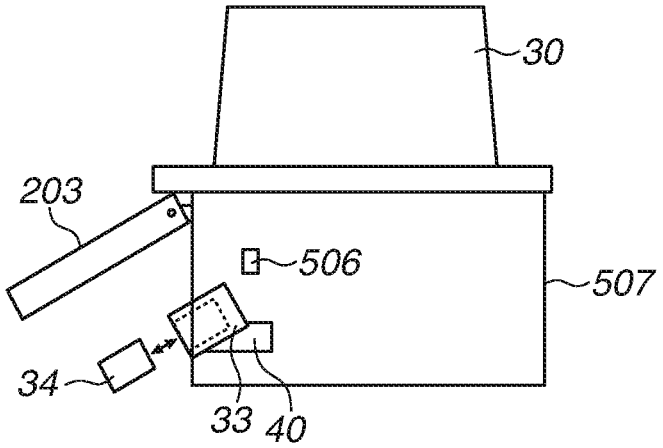

FIGS. 6A to 6C are overhead views of the post-processing apparatus 501 illustrating positions of the stapling unit 33. FIG. 6A illustrates a position of the stapling unit 33 at which automatic stapling and manual stapling are executed, i.e., stapling position. In other words, at this position, the stapling unit 33 executes stapling processing on a sheet bundle 505 discharged from the image forming apparatus 101 or inserted by the user through the discharge port 502. A sheet detection sensor 506 is arranged at a position different from the installation position in the first exemplary embodiment, and can detect not only the sheets regarded as a target of manual stapling but also the sheets that are stacked on the stapling tray 32 during the course of automatic stapling. FIG. 6B illustrates a position of the stapling unit 33 at which the staple cartridge 34 is replaced, i.e., cartridge replacement position. As illustrated in FIG. 6C, the user can open the door 203 to take out the staple cartridge 34 from the stapling unit 33 at the cartridge replacement position. In other words, the user can access and replace the staple cartridge 34 with a new cartridge when there is no staple in the staple cartridge 34. Similar to the configuration described in the first exemplary embodiment, the door 203 is provided on a side face of the apparatus main unit 507.

As illustrated in FIG. 6A, the stapling unit 33 is movable in a direction orthogonal to the discharge direction of the sheet bundle 505, i.e., a width direction of the sheet bundle 505. When the stapling position and the cartridge replacement position are compared to each other, the cartridge replacement position is set at a position closer to the door 203 than the stapling position in the direction orthogonal to the discharge direction of the sheet bundle 505.

Figure 7:
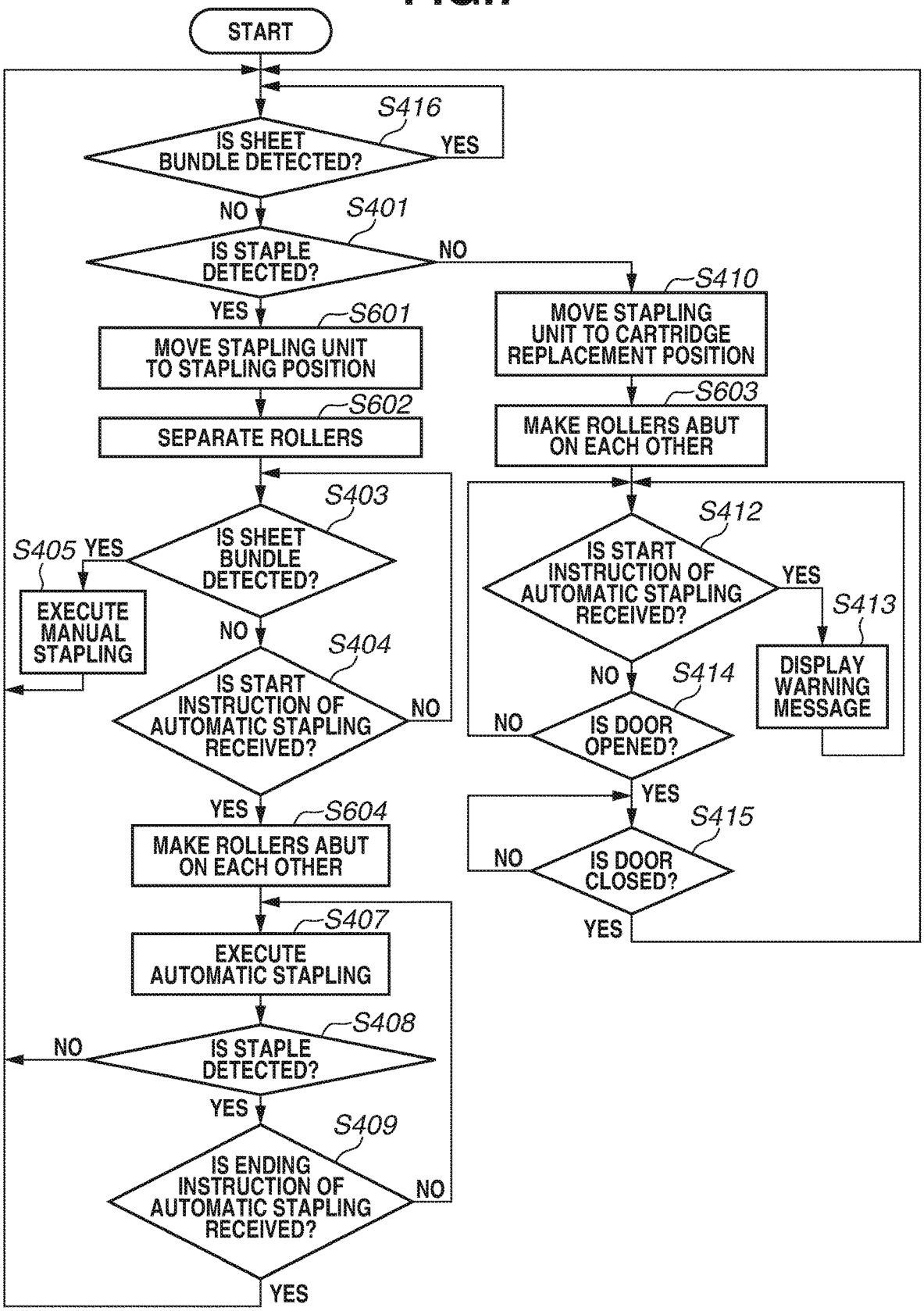
FIG. 7 is a flowchart illustrating operation of a stapling control unit of the second exemplary embodiment.

FIG. 7 is a flowchart illustrating operation of the conveyance control unit 308 and the stapling control unit 309 of the present exemplary embodiment. The control according to the flowchart in FIG. 7 is executed by the CPUs mounted on the conveyance control unit 308 and the stapling control unit 309 based on programs stored in ROMs. In the flowchart in FIG. 7, only processing different from the processing in FIG. 4 will be described while description of processing similar to the processing in FIG. 4 will be omitted.

In step S401, if a remaining staple is detected (YES in step S401), the processing proceeds to step S601. In step S601, the stapling control unit 309 controls the stapling unit moving mechanism 40 to move the stapling unit to a stapling position. Then, in step S602, the conveyance control unit 308 makes one roller of each of the discharge roller pair 503 and the drawing roller pair 504 separate from the other and allows a sheet bundle to be inserted from the discharge port 502 to prepare for manual stapling. If a sheet bundle inserted by the user is detected in step S403, in step S405, the stapling control unit 309 makes the stapling unit 33 execute manual stapling. At this time, the stapling unit 33 does not have to be moved because the stapling unit 33 has already stood ready at the stapling position.

If a start instruction of automatic stapling is received from the conveyance control unit 308 in step S404, in step S604, the conveyance control unit 308 makes the rollers of each of the discharge roller pair 503 and the drawing roller pair 504 abut on each other to prepare for automatic stapling. Thereafter, in step S407, according to the instruction of the conveyance control unit 308, the stapling control unit 309 makes the stapling unit 33 execute automatic stapling. At this time, the stapling unit 33 does not have to be moved because the stapling unit 33 has already stood ready at the stapling position.

In step S401, if absence of the staple is detected (NO in step S401), the processing proceeds to step S410. In step S410, the stapling control unit 309 controls the stapling unit moving mechanism 40 to move the stapling unit 33 to the cartridge replacement position. Then, in step S603, the conveyance control unit 308 makes the rollers of each of the discharge roller pair 503 and the drawing roller pair 504 abut on each other to prevent execution of manual stapling by inhibiting the sheet bundle being inserted from the discharge port 502. Thereafter, in step S412, the stapling control unit 309 monitors a start instruction of automatic stapling, but does not monitor insertion of a sheet bundle that is executed in step S411. The subsequent processing is similar to that in the first exemplary embodiment, so that description thereof will be omitted.

As described above, according to the present exemplary embodiment, if there is a remaining staple, the stapling position at which manual stapling is executable is set as the stand-by position of the stapling unit 33, so that stapling processing can be executed immediately after a sheet bundle is inserted to the discharge port 502. Then, if there is no staple, the cartridge replacement position is set as the stand-by position of the stapling unit 33, so that the user can promptly replace the staple cartridge 34. Further, by blocking the discharge port 502 in such a way that the rollers of each of the discharge roller pair 503 and the drawing roller pair 504 abut on each other, the user can be notified that manual stapling is not executable.

In a case where a staple does not remain in the staple cartridge 34 because of execution of manual stapling, the stapling control unit 309 does not change the position of the stapling unit 33 until removal of a sheet bundle is detected by the sheet detection sensor 506. This is because a leading end of the sheet bundle will be pressed against the stapling unit 33 to cause creases to be formed on the sheet bundle if the stapling unit 33 is moved in a state where the sheet bundle has been inserted. Further, the conveyance control unit 308 does not make the rollers of each of the discharge roller pair 503 and the drawing roller pair 504 abut on each other until removal of the sheet bundle is detected by the sheet detection sensor 506. This is because the user cannot take out the sheet bundle if the rollers of each of the discharge roller pair 503 and the drawing roller pair 504 abut on each other in a state where the sheet bundle has been inserted thereto. Accordingly, the stapling control unit 309 moves the stapling unit 33 to the cartridge replacement position after removal of the sheet bundle is detected by the sheet detection sensor 506. Then, the conveyance control unit 308 makes the rollers of each of the discharge roller pair 503 and the drawing roller pair 504 abut on each other after removal of the sheet bundle is detected by the sheet detection sensor 506.

In the above-described first and second exemplary embodiments, although the stapling unit 33 includes the staple presence/absence detection sensor 35, a configuration thereof is not limited thereto. Presence or absence of a staple may be detected by another unit. For example, a non-volatile memory is mounted on the post-processing control unit 303, and a number of execution times of stapling processing may be counted and stored in the non-volatile memory. Then, the post-processing control unit 303 may determine absence of the staple when the number of counts counted by a counter has reached a predetermined number of counts.

In the above-described first and second exemplary embodiments, although a laser beam printer is described as an example, the image forming apparatus to which the present disclosure is applicable is not limited to the above, so that the image forming apparatus may be a printer of another printing system such as an ink jet printer, or may be a copying machine.

While exemplary embodiments have been described, it is to be understood that the present disclosure is not limited to the disclosed exemplary embodiments. The scope of the following claims is to be accorded the broadest interpretation so as to encompass all such modifications and equivalent structures and functions.

What is claimed is:

1. A post-processing apparatus connectable to an image forming apparatus, the image forming apparatus for forming an image on a recording material, and the post-processing apparatus comprising:

a discharge roller pair configured to discharge a recording material through a discharge port formed on a main body of the post-processing apparatus, the discharge roller pair being capable of conveying the recording material in a reverse direction by being inversely rotated, the reverse direction being an opposite of a discharging direction, the discharging direction being a direction in which the discharge roller pair discharges the recording material;

a drawing roller pair provided downstream of the discharge roller pair in the reverse direction and configured to convey the recording material conveyed in the reverse direction by the discharge roller pair;

a stapling unit including a cartridge for containing a staple used for stapling processing, the stapling unit configured to execute the stapling processing on a recording material;

a detection unit configured to detect presence or absence of a staple in the cartridge;

a moving unit configured to move the stapling unit between a stapling position at which the stapling processing is executed on a recording material and a replacement position at which the cartridge is replaceable; and a control unit capable of executing an automatic mode and a manual mode, the automatic mode being a mode of causing the discharge roller pair to convey in the reverse direction the recording material discharged from the discharge port and causing the stapling unit to execute the stapling processing on the recording material conveyed in the reverse direction, the manual mode being a mode of causing the stapling unit to execute the stapling processing on a recording material inserted from outside the discharge port;

wherein the control unit brings the discharge roller pair into a separated state in a case where the manual mode is executed, and wherein the control unit causes the moving unit to move the stapling unit to the replacement position and brings the discharge roller pair into an abutting state from a separated state in a case where the detection unit detects the absence of a staple.

2. The post-processing apparatus according to claim 1, wherein the stapling unit is movable in a direction orthogonal to a discharge direction of a recording material, and a door is provided on a side face of the main body when viewed from a downstream side of the discharge direction, and wherein the replacement position is set to be positioned closer to the door than the stapling position in the direction orthogonal to the discharge direction.

3. The post-processing apparatus according to claim 1, wherein the stapling unit includes a staple presence/absence detection sensor for detecting the presence or the absence of a staple in the cartridge, and wherein the detection unit detects the presence or the absence of a staple in the cartridge based on a detection result of the staple presence/absence detection sensor.

4. The post-processing apparatus according to claim 1, wherein the detection unit includes a counter for counting a number of times the stapling processing is executed by the stapling unit, and detects the presence or the absence of a staple in the cartridge based on the number of times counted by the counter.

5. The post-processing apparatus according to claim 1, wherein the control unit brings the drawing roller pair into the separated state in a case where the manual mode is executed.

6. The post-processing apparatus according to claim 5, wherein the control unit brings the drawing roller pair into an abutting state in a case where the detection unit detects the absence of a staple.

* * * * *